US006131820A

United States Patent [19]

Dodd

[11] Patent Number: 6,131,820

[45] Date of Patent: Oct. 17, 2000

[54] DISCHARGE VALVE ASSEMBLY FOR TRIGGER SPRAYER

[75] Inventor: Joseph K. Dodd, Lee's Summit, Mo.

[73] Assignee: Calmar Inc., City of Industry, Calif.

[21] Appl. No.: 09/323,160

[22] Filed: Jun. 1, 1999

[51] Int. Cl.[7] ..... B05B 15/02; B05B 9/043; B05B 1/34; F23D 11/34; A62C 11/00

[52] U.S. Cl. ..... 239/106; 239/333; 239/492

[58] Field of Search ..... 222/383.1; 239/106, 239/119, 333, 492

[56] References Cited

U.S. PATENT DOCUMENTS

| | | | |
|---|---|---|---|
| Re. 33,235 | 6/1990 | Corsette | 222/383 |
| 4,527,741 | 7/1985 | Garneau | 239/333 |
| 4,706,888 | 11/1987 | Dobbs | 239/478 |
| 4,958,754 | 9/1990 | Dennis | 222/383 |
| 5,114,052 | 5/1992 | Tiramani et al. | 239/333 |
| 5,181,658 | 1/1993 | Behar | 239/493 |
| 5,234,166 | 8/1993 | Foster et al. | 239/333 |
| 5,509,608 | 4/1996 | Foster et al. | 239/333 |
| 5,518,147 | 5/1996 | Peterson et al. | 222/153.07 |
| 5,535,950 | 7/1996 | Barraic et al. | 239/333 |
| 5,593,093 | 1/1997 | Foster et al. | 239/333 |
| 5,711,459 | 1/1998 | Glynn | 239/333 |
| 5,785,208 | 7/1998 | Dobbs et al. | 222/148 |

*Primary Examiner*—Andres Kashnikow
*Assistant Examiner*—Davis Hwu
*Attorney, Agent, or Firm*—Dykema Gossett PLLC

[57] ABSTRACT

A trigger actuated pump sprayer has a discharge valve assembly located in the discharge barrel of the pump body which includes a filler for reducing the volume of the discharge barrel thereby displacing the air therein whereupon the strokes-to-prime ratio of the pump required during initial pumping for discharging pressurized liquid along the barrel and through the orifice at a nozzle end thereof, is improved. Also the discharge valve assembly may be shiftable along the length of the discharge barrel in response to pressure and return strokes during pumping, a downstream end of the assembly engaging a spin mechanics element at the nozzle end to therewith define a variable volume suction chamber in communication with the discharge orifice for withdrawing product therefrom during each pumping suction stroke.

45 Claims, 3 Drawing Sheets

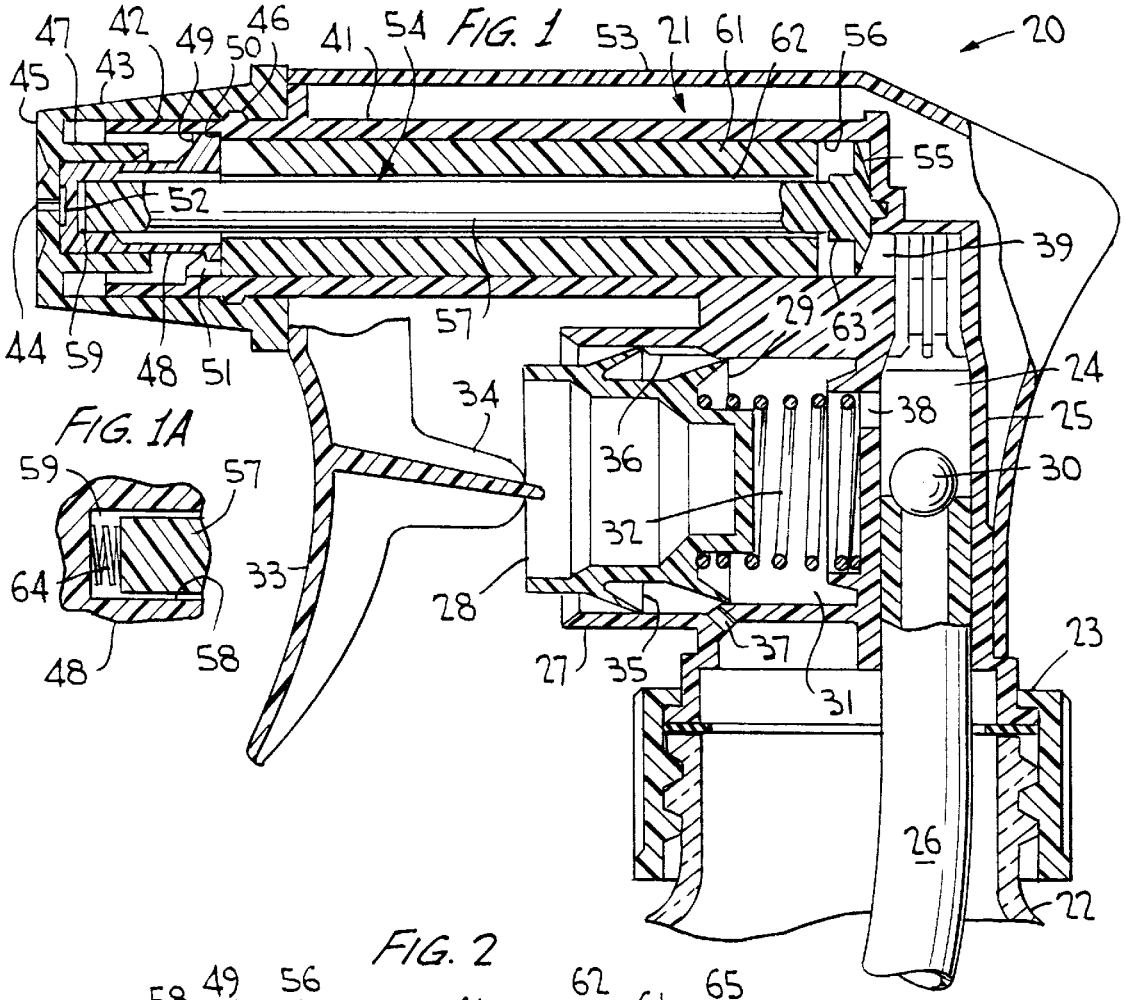
FIG. 1
20
21
22
23
24
25
26
27
28
29
30
31
32
33
34
35
36
37
38
39
41
42
43
44
45
46
47
48
49
50
51
52
53
54
55
56
57
59
61
62
63
FIG. 1A
64
58
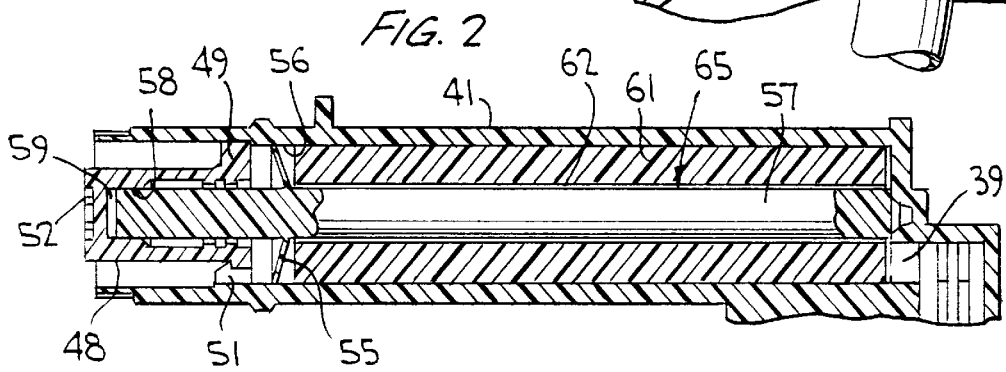
FIG. 2
39
41
48
49
51
52
55
56
57
58
59
61
62
65
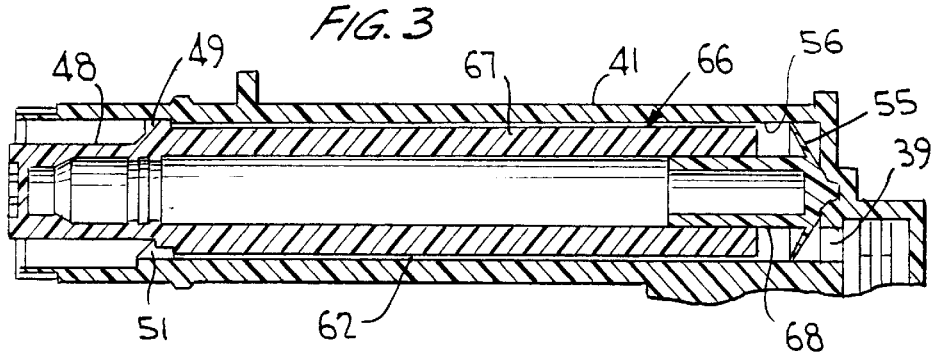
FIG. 3
39
41
48
49
51
55
56
62
66
67
68

DISCHARGE VALVE ASSEMBLY FOR TRIGGER SPRAYER

BACKGROUND OF THE INVENTION

This invention relates generally to a discharge valve assembly for a trigger actuated pump sprayer, and more particularly to such a valve assembly as having a product retraction feature to avoid the formation of dribbles and drips of liquid product at the discharge orifice when in use. Another feature of the invention provides for reducing the volume of the discharge passage leading from the pump chamber to the discharge orifice to aid in pump priming.

Trigger actuated pump sprayers are known to have certain basic features, namely, a trigger actuated piston operating in a rump cylinder, a valve controlled inlet leading to the pump chamber, and a valve controlled discharge leading away from the chamber. During each piston return stroke, the internal pump pressure falls below atmospheric as the pump chamber volume expands to thereby induce the flow of liquid product into the chamber from the container through the inlet via an unseated inlet check valve. The pump chamber is thus charged (or primed) and recharged with liquid product during each suction stroke. And during induction of the product the discharge check valve is drawn closed against its valve seat to both seal the discharge closed and to facilitate pump priming. During each pressure stroke product is discharged from the pump chamber thereby sealing the inlet closed as the inlet check valve is forced against its valve seat, while applying pressure against the discharge check valve to move it from its valve seat to thereby open the discharge to the orifice at the exit end thereof. Examples of the known pump sprayers are: Model No. TS-800 manufactured by Calmar Inc.; U.S. Pat. No. RE 33,235; 4,527,741; 5,234,166; and 5,509,608.

Oftentimes residual product in the discharge passage leading to the exit opening tends to accumulate at the discharge orifice after the closing of the discharge valve thereby forming dribbles and drips (product drooling) at the orifice, which is undesirable.

The trigger sprayer is typically structured as having a relatively long discharge barrel leading from the pump chamber to the discharge orifice at the nozzle end thereof. The discharge barrel defining the discharge passage is formed integrally with the pump body during the molding operation and is thus sized sufficiently to facilitate ease in molding. The diameter and length of the discharge passage, however, provides a volume which fills with product during the pumping operation and remains substantially filled during use. When the pump chamber is primed liquid product is drawn into the pump chamber during each return stroke incrementally and is discharged from the chamber during each pressure stroke into the discharge flow path which extends between the outlet from the pump chamber to the discharge orifice. During the initial pressure strokes the discharge path is gradually filled with product and it is the strokes-to-prime ratio which is one of several factors determining pump performance.

The volume reduction of the discharge passage has been found a factor in reaching an acceptable strokes-to-prime ratio, as less volume is required to be occupied by product during the initial pressure strokes, thereby effecting an earlier discharge through the orifice.

SUMMARY OF THE INVENTION

It is therefore an object of the present invention to provide an improved discharge valve assembly for a trigger actuated pump sprayer having an anti-drool feature. For this purpose a suction chamber is defined between a slidable valve assembly and a spin mechanics element fixed at the nozzle end of the discharge barrel, the suction chamber communicating with the discharge orifice. The valve assembly reciprocates during pressure and return strokes to not only valve product toward the discharge orifice, but to reciprocate in the discharge barrel for suctioning product inwardly of the discharge orifice to avoid the formation of dribbles and drips thereat.

Otherwise the discharge valve assembly may be stationary within the discharge barrel, and a discharge passage volume reducer is provided to restrict the accumulation of product within the passage to thereby aid in pump priming. The volume reducer may be in the form of a sleeve or a cylinder or the like. The valve assembly includes an elastomeric circular valve disc in sealing engagement along its outer periphery with an inner wall of the discharge barrel in the valve closed condition, at least a portion of such outer periphery disengaging the inner wall in a valve open condition.

The discharge passage volume reducer may likewise be provided for that embodiment of the invention which includes a longitudinally slidable valve assembly provided to withdraw product inwardly of the discharge orifice.

Other objects, advantages and novel features of the invention will become more apparent from the following detailed description of the invention when taken in conjunction with the accompanying drawings.

BRIEF DESCRIPTION OF THE DRAWINGS

FIG. 1 is a vertical sectional view of a trigger actuated pump sprayer incorporating both an anti-drool feature and a pump priming aid according to the invention;

FIG. 1A is a partial view similar to that of FIG. 1 of a modification of the anti-drool feature; and FIGS. 2, 3, 4, 5, 6, 7, 8, 9, 10 and 11 are vertical sectional views similar to that of FIG. 1 of variations of both embodiments of the invention.

DETAILED DESCRIPTION OF THE INVENTION

Figure 4:
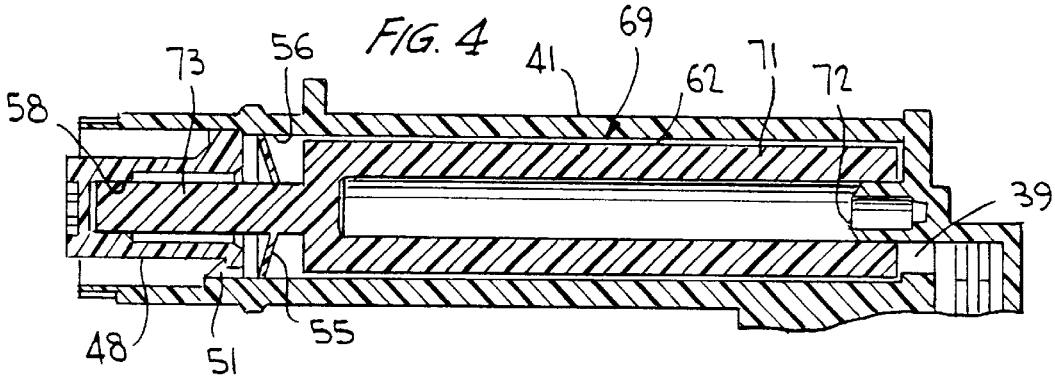

Turning now to the drawings wherein like reference characters refer to like and corresponding parts throughout the several views, a manually actuated pump dispenser incorporating the invention is generally designated 20 in FIG. 1 as comprising a pump body 21 adapted to be mounted to the neck of a container 22 of liquid product to be dispensed, utilizing an internally threaded closure cap 23. A snap closure could (not shown) otherwise be provided for mounting the pump body or the container, or the pump body could be mounted to the container neck utilizing a bayonet-type fitment (not shown).

The pump body includes an inlet passage 24 defined by an upstanding cylindrical portion 25 of the pump body which suspends a conventional dip tube 26 immersed at its free end in liquid product (not shown) in the container, the dip tube being suspended by tight frictional engagement with the inner wall of portion 25. The dip tube may be otherwise suspended from portion 25 in any known manner.

The pump body likewise includes a pump (cylinder 27 for the reception of a manually reciprocable pump piston 28 having an inboard annular piston seal 29 defining together with the pump cylinder a variable volume pump chamber 31. An inlet ball check valve 30 or the like is provided for valving the inlet in any known manner. A piston return spring 32 is provided, which may be internally of the pump chamber as shown or which may be external to the pump chamber (not shown), for returning the piston to its FIG. 1 position after each pressure stroke. A trigger actuator 33 is pivotally mounted on the pump body, the trigger having a projection 34 engaging an outer edge of the piston for reciprocating the piston upon each pull of the trigger against the force of return spring 32. The piston may likewise have an outboard annular vent seal 35 in sealing engagement with the inner wall of the pump cylinder outboard of a longitudinal rib or ribs 36 on the inner wall for breaking the seal during piston reciprocation to open vent port 37 to atmosphere to thereby vent the interior of the container. See RE33,235 for a detailed disclosure of the aforedescribed trigger sprayer.

Cylindrical portion 25 has a port 38 through which liquid product enters and exits the pump chamber, the port communicating via an opening 39 with a substantially horizontal discharge barrel 41 through which liquid product passes, the terminal end of barrel 41 defining a nozzle 42.

A nozzle cap 43 having a discharge orifice 44 provided in its front wall 45, is snap-fitted as at 46 to nozzle 42 for rotation without axial movement between on and off positions. The cap has an inner cylindrical sleeve 47 with internal longitudinal passages, the sleeve surrounding a spin mechanics element 48 mounted within nozzle 42, element 48 having circumferentially spaced apart ears 49, one of which engages a detent 51 for snap fitting element 48 in place against rotation. A stop shoulder 50 or the like may be provided internally of the barrel for mounting the spin mechanics element against axial movement.

The front wall of element 48 defines a spin chamber 52 as having a plurality of tangential and radial grooves extending between that chamber and longitudinal grooves provided on the outer wall of element 48. Upon rotation of nozzle cap 43, the internal grooves within sleeve 47 and the external grooves on element 48 match or mismatch for opening and closing the discharge orifice, all as described in detail in commonly owned U.S. Pat. No. 4,706,888, the entire disclosure of which being incorporated herein by reference. And, the pump body may be covered with a shroud 53 snapped or otherwise mounted thereto in some normal manner.

A discharge valve assembly 54 is located within barrel 41, the assembly including an elastomeric circular valve disc 55 in sealing engagement along its outer periphery with inner wall 56 of barrel 41. The valve which may be frusto-conical as shown, has an outer diameter slightly greater than the inner diameter of wall 56 as to inherently provide a biasing action of the valve against wall 56. The conical valve is sometimes referred to as a chevron valve.

Assembly 54 is disposed within discharge barrel 41 for longitudinal shifting movement therealong, the assembly further including support means for the valve and the spin mechanics element which may be in the form of an elongated cylindrical rod 57 with which valve 55 may be integrally molded.

Spin mechanics element 48 has a central, cylindrical depression 58 (FIG. 1A) which may be either slightly oversized relative to the diameter size of rod 57, or which may have one or more longitudinal grooves formed on its inner wall. The downstream end of rod 57 extends into depression 58 and therewith defines a variable volume suction chamber 59 in open communication with orifice 44 in the discharge open rotative position of the nozzle cap.

A hollow sleeve 61 may surround rod 57, the inner diameter of the sleeve being slightly greater than the diameter of rod 57 to the-with define an annular discharge passage 62. Sleeve 61 functions as a means for reducing the volume of discharge barrel 41 for a purpose to be explained more fully hereinafter. And, one or more longitudinal ribs 63 or the like may be provided on rod 57 adjacent valve 55, the ribs acting as spacers for sleeve 61 to maintain the sleeve axially spaced from the valve to avoid any interference during valve opening.

In operation, assuming that pump chamber 31 is primed with liquid product, each inward (pressure) stroke applied to the piston upon each pull of the trigger increases the pressure of the liquid at the upstream side of valve 55 causing at least a portion of the valve periphery to disengage from inner wall 56 to thereby open the discharge permitting liquid under pressure to flow through passage 62 and out through orifice 44 as a spray or a stream depending on the manual setting of nozzle cap 43. Pressurized product from the pump chamber acting against the upstream face of valve 55 likewise causes the entire valve assembly 54 to longitudinally shift in a downstream direction whereupon rod 57 reciprocates within depression 58 thereby evacuating chamber 59 of any fluid. Upon relaxation of the manual force applied against the trigger, the pump piston shifts outwardly of its cylinder bore under the influence of the force of return spring 32 as in any normal manner, to thereby expand pump chamber 31 which functions to draw liquid up the dip tube and into the pump chamber via the unseated valve check ball 30 and port 38. This sub-atmospheric pressure created by the expanding pump chamber likewise causes valve 55 to tightly reseal against inner wall 56 by reason of the pressure differential existing on opposite sides of the valve. The closing of the discharge valve permits the pump chamber to be primed as aforedescribed. And the sub-atmospheric pressure created at the upstream side of valve 55 causes rod 57 to reciprocate upstream n a direction outwardly of chamber 59 to thereby create a sub-atmospheric condition therein for suctioning any residual product from orifice 44 to avoid the formation of dribbles and drips thereat.

During each pressure stroke of the piston product flows into and through discharge barrel portion 41 before discharging out of the orifice in the form of a spray or a stream, depending on the setting of the discharge nozzle. Without the inclusion of sleeve 61, the volume of barrel 41 is significantly greater, and this volume is initially air filled before pump priming such that the liquid product displaces the air gradually during each initial pressure stroke. The strokes-to-prime ratio experienced during initial pumping without the provision of a volume reducer, has been shown to be higher than acceptable.

The provision of sleeve 61, surrounding rod 57, significantly reduces the volume of discharge barrel 41 and defines a thin, annular discharge passage 62 together with the rod. Sleeve 61 therefore functions as a priming aid as it displaces the air in barrel 41, such that a reduced volume of air must be initially displaced by the liquid product, as it passes through the discharge during the initial pressure strokes. It has been shown that with the provision of the volume reducer the strokes-to-prime ratio drops to a more acceptable level.

As mentioned earlier, during each piston return stroke, the valve assembly retracts as it shifts slightly rearwardly in an upstream direction to thereby expand suction chamber 59. The expanding chamber, being in open communication with discharge orifice 44, functions to retract product into and behind the orifice which may collect outwardly of the orifice in the form of product dribbles or drips, to therefore provide an anti-drooling effect.

A light spring 64 of some type, FIG. 1A, may be provided in suction chamber 59 between the bottom wall of the chamber and the front wall of rod 57, for assisting in retracting the discharge valve assembly to cause it to shift outwardly of chamber 59 during each piston return stroke. The spring 64 may be in the form of a coil spring, a leaf spring, or any equivalent light spring, without departing from the invention.

FIGS. 2 to 11 show various modifications of the discharge valve assembly according to the invention. For example, discharge valve assembly 65 of FIG. 2 is similar to valve assembly 54 of FIG. 1 in that they both include rod 57 as having an integrally molded conical valve disc 55 which is spring biased under its own resiliency along its periphery which bears against inner wall 56 of barrel 41. And, valve assembly 65 is movable longitudinally within cylindrical depression 58 of spin mechanics element 48 to therewith define the variable volume suction chamber 59 as described in detail with reference to FIG. 1.

A hollow sleeve 61 surrounds rod 57 and therewith defines an annular discharge passage 62 through which liquid product under pressure during pumping passes and applies pressure against the upstream side of valve 55 to both deform the valve into an open position and to shift the valve assembly downstream, causing the tip of the rod to reciprocate within chamber 59. Valve assembly 65 and volume reducer 61 function in the same manner as described with reference to FIG. 1. As seen in FIG. 2, the main difference between valve assembly 54 and valve assembly 65 is that in the latter the valve disc is located further downstream in barrel 41 as compared to the upstream location of disc 55 in FIG. 1.

Discharge valve assembly 66 in the FIG. 3 embodiment comprises a combined filler in the form of a tubular portion 67 integral With spin mechanics element 48, which is otherwise identical to that described with reference to FIG. 1. Assembly 66 is fixed within cylindrical portion 41 as one of its ears 49 is snap-fitted to detent 51. And the assembly may include a separate valve element 68 on which conical valve 55 is formed, the valve being seated along its outer periphery against inner wall 56 for closing discharge passage 62 formed between the outer diameter of tubular portion 67 and the inner diameter of cylindrical portion 41. Valve element 68 may be simply telescoped within the open end of portion 67 in frictional engagement with the wall at the inner diameter thereof.

Discharge valve assembly 69 of the FIG. 4 embodiment comprises a hollow tubular section 71 fixed within discharge barrel 41, such as by frictional engagement with a peg 72 provided on pump body 21, the discharge valve assembly further including an integral rod portion 73 fixed to a separate spin mechanics element 48 upon frictional engagement with the wall of depression 58 thereof. Conical valve disc 55 may be formed integrally with rod portion 73, shown seated in place as its outer periphery seals against the inner wall 56 of portion 41. Discharge passage 62 is established between the outer diameter of section 71 and the inner diameter of barrel 41, such that liquid product under pressure passing therethough bears against the upstream side of valve disc 55 causing it to deform and at least a portion thereof to move away from its valve seat to thereby open the discharge to the discharge orifice.

Figure 5:
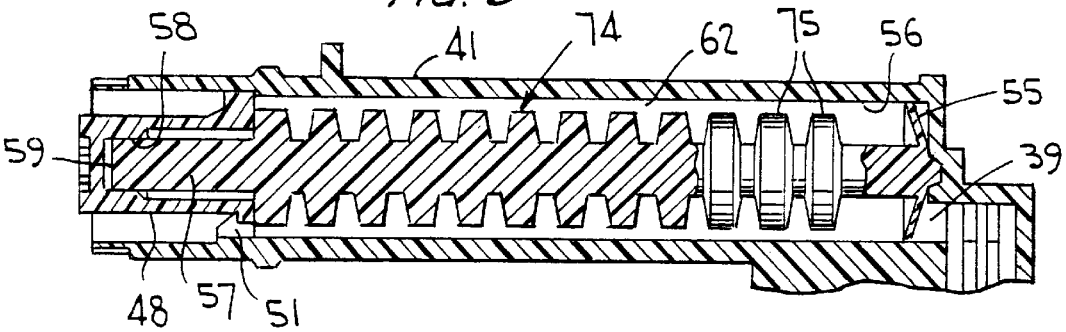

In the FIG. 5 embodiment, discharge valve assembly 74 is, as discharge valve assemblies 54 and 65 of FIGS. 1 and 2, mounted within discharge barrel 41 for longitudinal shifting movement so as to provide a similar anti-drool feature. The assembly includes a rod 57 engageable with the wall of cylindrical depression 58 of spin mechanics 48 to therewith define variable volume suction chamber 59 to effect product retraction at the discharge orifice as in the manner and for the purpose as described with reference to FIG. 1. Rod 57 has at its upstream end an integral conical valve 55 which, as in the foregoing embodiments, has its outer peripheral edge in sealing engagement with the inner wall 56 of portion 41 for closing discharge passage 62. Also valve assembly 74 includes along the length of its rod 57 a plurality of spaced integral circular discs 75 or the like which function as a filler to reduce the volume within barrel 41 to thereby function in the same or similar manner as filler elements 61, 71 and 61 as aforedescribed. Discharge valve assemble 74 shifts in a downstream direction during each pressure stroke which supplies product under pressure against the upstream side of valve disc 55 thereby deforming at least a portion of that disc for opening discharge passage 62 and for likewise effecting a longitudinal shift of the assembly within barrel 41 to thereby provide an anti-drool feature. The valve assembly retracts during each suction stroke of the piston as the pressure on the upstream side of valve disc 55 is below atmospheric relative to the pressure on the downstream side thereof, to thereby retract rod 57 out of cylindrical depression 58. As in the FIG. 1 embodiment, a light return spring 64 of some selected type can be provided to assist in the retraction process of the valve assembly.

Figure 6:
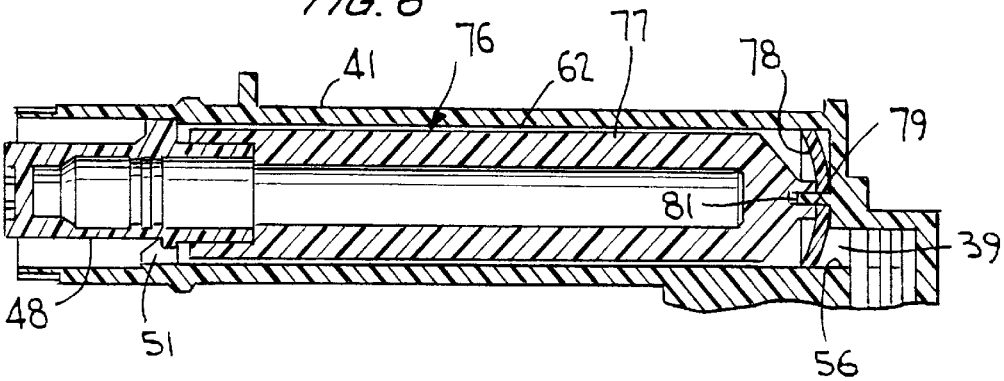

Discharge valve assembly 76 of the FIG. 6 embodiment includes a hollow tubular section 77 in frictional engagement with spin mechanics element 48 so as to be thereby fixed within discharge barrel 41. A discharge valve disc 78, of flexible, elastomeric material, is deformed when assembled within barrel 41 such that it assumes a concave shape as shown which possess an inherent biasing capacity as its outer peripheral edge sealingly engages against inner wall 56 out barrel 41 for valving discharge passage 62. The valve disc may be mounted in place by the provision of a central opening 79 therein through which a pin 81 on the pump body extends. Section 77 may engage the pin as shown, or the pin may be provided on section 77 and be extended through central opening 79 of the valve disc for stabilizing the same within barrel 41.

Figure 7:
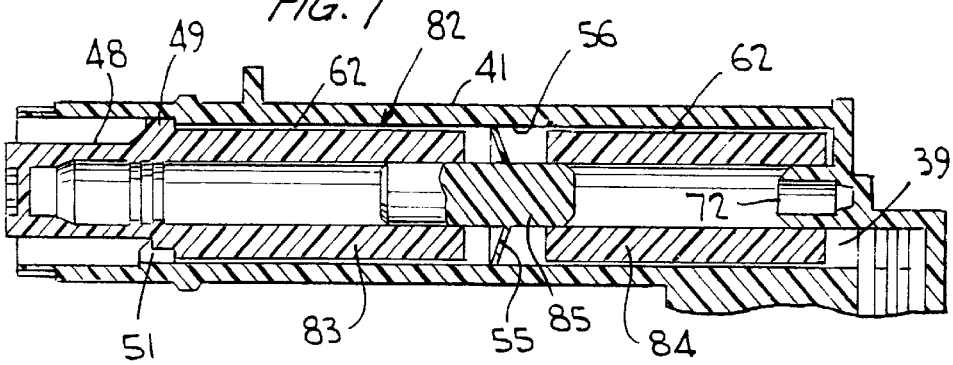

Discharge valve assembly 82 of the FIG. 7 embodiment is fixed within barrel 41 as an ear 49 on spin mechanics element 48 engages detent 51. The assembly includes a downstream tubular section 83 formed integrally with element 48, and an upstream sleeve 84 fixed in place by frictional engagement with peg 72. A valve element 85 carrying conical discharge valve 55 interconnects section 83 and sleeve 84 as it frictionally engages the interior hollow ends thereof as shown. Discharge passage sections 62 are established between the inner diameter of barrel 41 and the outer diameters of sleeve 84 and of tubular section 83 respectively. As shown conical valve 55 is substantially intermediate the upstream and downstream ends of barrel 41, as compared to the locations of the discharge valves in the foregoing embodiments. Valve 55 functions similarly as described above for valving product through the discharge passage, and elements 83, 84 of the discharge valve assembly function as filler elements for reducing the volume of barrel 41 as for the purpose and in the manner as described with reference to FIG. 1.

Figure 8:
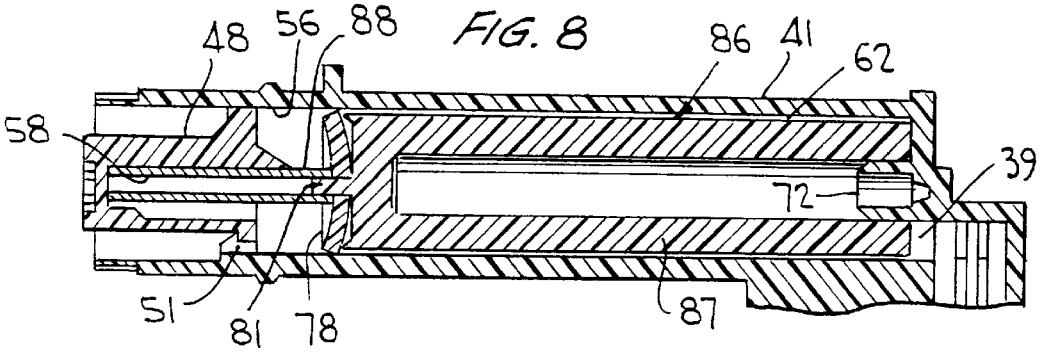

In the FIG. 8 embodiment discharge valve assembly 86 includes filler element in the form of a tubular section 87 fixed within portion 41 as it frictionally engages with peg 72. Discharge valve disc 78, which may be of The same or similar type as described with reference to FIG. 6, is mounted via its central opening on pin 81 at the downstream end of section 87. And, the valve assembly includes a hollow tubular extender 88 engaging pin 81 and cylindrical depression 58 of the spin mechanics element.

Figure 9:
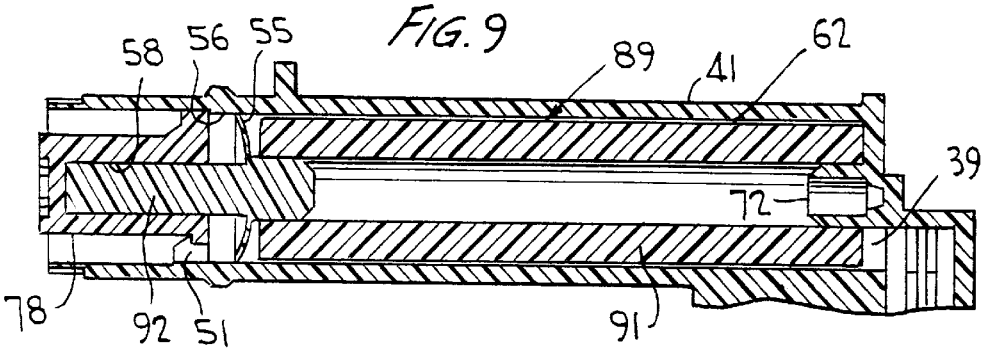

Discharge valve assembly 89 of FIG. 9 includes a hollow sleeve 91 fixed to peg 72 and functioning as a filler element, the sleeve defining together with the inner wall of barrel 41 a discharge passage 62. Valve element 92 interconnects spin mechanics element 48 with sleeve 91 via frictional engagement as shown. Conical valve element 55 is formed on element 92 which functions to valve product through the discharge passage similarly as described with reference to the other embodiments.

Figure 10:
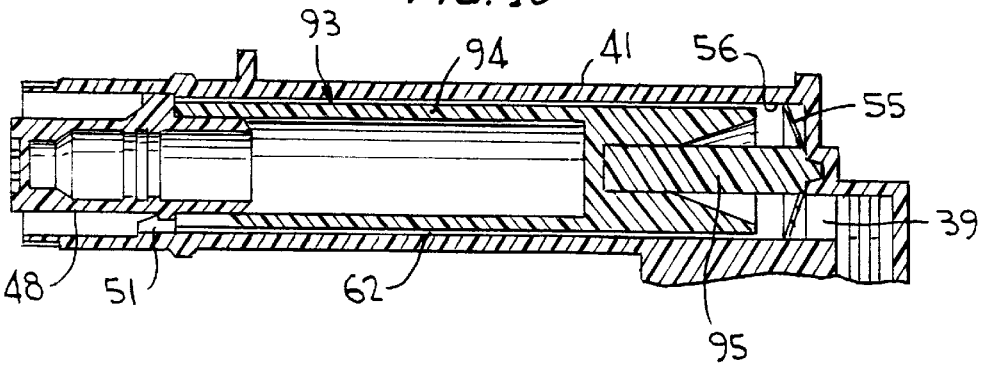

Discharge valve assembly 93 in FIG. 10 comprises a tubular element 94 fixed within cylindrical portion 41 and connected to sp n mechanics element 48 by frictional engagement as shown. The assembly further has a valve element 95 to which conical valve 55 is integrally molded, the valve element being fixed to tubular element 94 upon frictional engagement. Element 94 defines an annular discharge passage 62 together with inner wall 56, and valve 55 is seated against wall 56 about its annular outer edge. Element 94 functions as a filler for reducing the volume of cylindrical portion 41 as for the purpose and functioning in the manner described with reference to FIG. 1.

Figure 11:
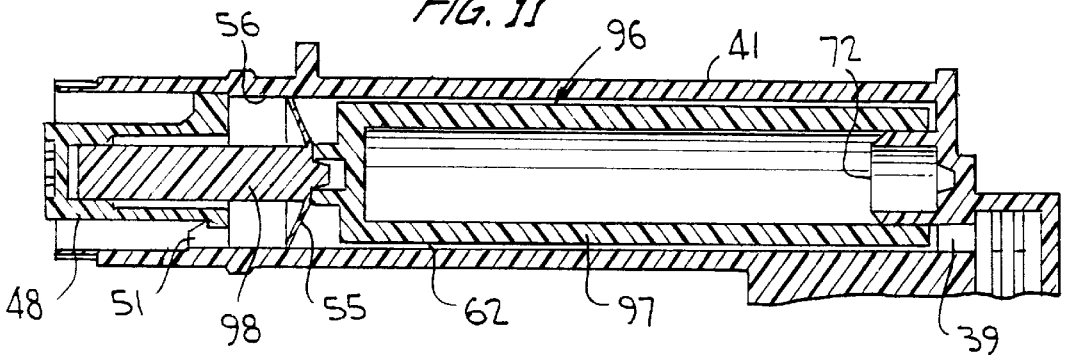

Lastly, the FIG. 11 embodiment has a discharge valve assembly 96 which includes filler element formed as a molded cylinder 97 fixed to peg 72 at its upstream end, and being supported against valve element 98 which extends into frictional engagement with spin mechanics element 48. The valve element includes a conical discharge valve 55 which, as in all other embodiments, is seated along its outer periphery against inner wall 56 for valving discharge passage 62 which is defined between cylinder 97 and wall 56.

From the foregoing it can be seen that a variety of discharge valve assemblies have been provided for a trigger actuated pump sprayer each having a filler for reducing the volume of the discharge barrel which displaces a substantial volume of air such that product is discharged through the discharge barrel more rapidly toward the discharge exit orifice during the initial pump pressure strokes. The strokes-to-prime ratio for the pump is therefore improved by a simple measure which may be require a separate sleeve-like filler or a cylindrical section of the discharge valve assembly which may take a wide variety of forms. The discharge valve may be in the form of a conical valve or a disc valve shaped into a concave face upon assembly, either such valve being seated along its outer periphery against the confronting inner wall of the discharge barrel. The valve may be located at a variety of positions along the length of the barrel.

In addition to the strokes-to-prime ratio improvement, the discharge valve assemblies according to several embodiments of the invention are shiftable in an axial direction along the length of the discharge barrel so that a rod or rod portion as part of the valve assembly slides within a cupped depression of the spin mechanics element to therewith define a variable volume suction chamber. That chamber is in fluid communication with the discharge orifice for thereby drawing or retracting product from and around the discharge orifice to avoid the formation of product droplets thereat. Such an anti-drool feature requires no additional parts and is a simple, yet highly effective means of avoiding the formation of any product dribbles and drips at the discharge orifice. Of course, the anti-drool feature can be provided independently of a discharge volume reducer, without departing from the invention.

Obviously many other modifications and variations of the present invention are made possible in the light of the above teachings. It is therefore to be understood that within the scope of the appended claims the invention may be practiced otherwise than as specifically described.

What is claimed is:

1. A trigger actuated prump sprayer comprising, a pump body having a cylindrical discharge barrel in communication with a variable volume pump chamber defined by a manually reciprocalable piston operating between pressure and return strokes within a pump cylinder of said body for discharging liquid product through a discharge orifice at a downstream end of said barrel, a spin mechanics element fixed at said downstream end, a discharge valve assembly slidably disposed within said barrel and including an elastomeric circular valve disc and means engaging said spin mechanics element to therewith define a variable volume suction chamber, said valve disc being in sealing engagement along its outer periphery with an inner wall of said barrel in a valve closed condition during the piston return strokes to prevent the passage of liquid product from said discharge barrel to said pump chamber, at least a portion of said outer periphery disengaging said inner wall in a valve open condition during the piston pressure strokes to permit the passage of liquid product under pressure through said discharge orifice, said valve assembly being slidably movable along said discharge barrel toward and away from said spin mechanics element respectively during said valve open and valve closed conditions, said suction chamber being expanded during the movement away from said element for retracting liquid product inwardly of said discharge orifice to avoid any formation of dribbles and drips thereat.

2. The pump sprayer according to claim 1, further comprising a filler member disposed within said discharge barrel for substantially reducing the volume thereof and defining a discharge passage in communication with said orifice to reduce volume of liquid product within said barrel during pumping operation.

3. The pump sprayer according to claim 1, wherein said means of said valve assembly comprises a rod slidable within a cupped depression in said element for defining said suction chamber.

4. The pump sprayer according to claim 3, wherein spring means are provided in said suction chamber for biasing said rod away from said element.

5. The pump sprayer according to claim 1, wherein said discharge valve is located at an upstream end of said barrel.

6. The pump sprayer according to claim 2, wherein said discharge valve is located at an upstream end of said passage, said means on said valve assembly comprises a rod, and said filler member comprising a sleeve surrounding said rod and therewith defining said discharge path.

7. The pump sprayer according to claim 6, wherein means is provided on said rod for axially spacing said sleeve away from said valve to avoid interference in the valve open condition.

8. The pump sprayer according to claim 1, wherein said discharge valve is located adjacent said downstream end of said barrel.

9. The pump sprayer according to claim 2, wherein said discharge valve is located adjacent said downstream end of said passage, said means of said valve assembly comprising a rod, and said filler member comprising a sleeve surrounding said rod and therewith defining said discharge passage.

10. The pump sprayer according to claim 9, wherein said rod extends to an upstream end of said passage.

11. The pump sprayer according to claim 5, wherein said means of said valve assembly comprises an elongated member having an enlarged section for substantially filling said barrel to reduce volume of liquid product within said barrel during pumping operation.

12. The pump sprayer according to claim 1, wherein said valve comprises a conical valve sloping in a downstream direction.

13. The pump sprayer according to claim 1, wherein said valve has a concave side facing in an upstream direction.

14. A discharge valve assembly adapted for use in a trigger operated pump sprayer to be mounted on a liquid container, the sprayer having a pump body including a discharge barrel and a pump for discharging liquid product from the container through the barrel and from a discharge orifice at a downstream end of the barrel, the valve assembly comprising a flexible valve disc of greater diameter than the diameter of said barrel to resiliently engage the inner wall of said barrel in a valve closed position and to disengage said inner wall in a valve open position, said assembly further comprising means defining spin mechanics fixed at said downstream end and support means for said spin mechanics means and said valve disc, said support means extending between an upstream end of said barrel and said downstream end, said support means having means substantially reducing the volume of said passage while maintaining a discharge passage toward said orifice to reduce volume of liquid product within said passage during pumping operation.

15. The valve assembly according to claim 14, wherein said valve disc is located at said upstream end.

16. The valve assembly according to claim 15, wherein said support means comprises a rod movable along said passage in response to pressure and suction strokes applied during pumping, said rod engaging a cavity in said spin mechanics means to therewith define a variable volume suction chamber during rod movement for retracting liquid product from said orifice during pumping to avoid formation of dribbles and drips thereat.

17. The valve assembly according to claim 14, wherein said volume reducing means comprises a sleeve member surrounding on said support means.

18. The valve assembly according to claim 15, wherein said support means comprises a rod, and said volume reducing means comprises a hollow tube surrounding said rod.

19. The valve assembly according to claim 14, wherein said valve disc is located adjacent said spin mechanics means.

20. The valve assembly according to claim 14, wherein said support means comprises a cylindrical member with which said spin mechanics means is integrally formed, said cylindrical member having an outer diameter slightly less than the barrel diameter for defining said volume reducing means.

21. The valve assembly according to claim 14, wherein said valve disc comprises a frusto-conical valve skirt sloping toward said inner wall in a downstream direction.

22. The valve assembly according to claim 14, wherein said support means comprises a cylindrical member coupled to said spin mechanics means, said cylindrical member having a diameter size relative to said barrel to define said volume reducing means.

23. The valve assembly according to claim 22, wherein said valve disc is integrally formed with said cylindrical member.

24. The valve assembly according to claim 14, wherein said support means comprises a rod coupled to said spin mechanics means, said rod having an enlarged section defining said volume reducing means.

25. The valve assembly according to claim 16, wherein said rod has an enlarged section defining said volume reducing means.

26. The valve assembly according to claim 14, wherein said valve disc is located between said upstream and downstream ends.

27. The valve assembly according to claim 26, wherein said support means comprises a cylindrical member formed integrally with said spin mechanics means.

28. The valve assembly according to claim 14, wherein said support means comprises a cylindrical member to which said valve disc is mounted adjacent said spin mechanics means, and an extender for coupling said spin mechanics means to said cylindrical member.

29. The valve assembly according to claim 28, wherein said cylindrical member has a diameter sized to the diameter of said inner wall as to comprise said volume reducing means.

30. The valve assembly according to claim 14, wherein said support means comprises a cylindrical member and an extender for coupling said spin mechanics means to said cylindrical member, said valve disc being formed integrally with said extender.

31. The valve assembly according to claim 14, wherein said support means comprises a cylindrical member coupled to said spin mechanics means, and a peg on said pump body coupled to said cylindrical member, said valve disc being mounted to said peg.

32. A discharge valve assembly adapted for use with a pump sprayer to be mounted on a liquid container, the sprayer having a pump body including a discharge barrel having a discharge orifice at a downstream end thereof, the valve assembly comprising a flexible valve disc having an outer peripheral edge in sealing engagement with an inner wall of said barrel in a valve closed position, means comprising spin mechanics fixed at said downstream end, and a filler member disposed in said barrel extending substantially between an upstream end of the barrel and said spin mechanics means for reducing volume of the liquid product within the barrel during operation of the pump sprayer, said filler member defining a discharge passage for the discharge of liquid product from the orifice.

33. The discharge valve assembly according to claim 32, wherein the valve is connected to the spin mechanics means for movement along the length of the barrel during pump operation.

34. The discharge valve assembly according to claim 32, wherein the valve disc is of flexible material.

35. The discharge valve assembly according to claim 33, wherein the valve is located adjacent the upstream end of the barrel.

36. The discharge valve assembly according to claim 33, wherein the valve is located adjacent the downstream end of the barrel.

37. The discharge valve assembly according to claim 32, wherein the filler member interconnects the spin mechanics means with the valve.

38. The discharge valve assembly according to claim 37, wherein the valve is located adjacent the upstream end of the barrel.

39. The discharge valve assembly according to claim 37, wherein the valve is located adjacent the downstream end of the barrel.

40. The discharge valve assembly according to claim 37, wherein the valve is located between said upstream and downstream ends.

41. A discharge valve assembly adapted for use with a pump sprayer to be mounted on a liquid container, the sprayer having a pump body including a discharge barrel defining a discharge passage having a discharge orifice at a downstream end thereof, the valve assembly comprising a flexible valve disc having an outer peripheral edge in sealing engagement in a valve closed condition with an inner wall of said barrel defining a valve seat, said peripheral edge disengaging said inner wall in a valve open condition, means comprising spin mechanics fixed at said downstream end, said valve assembly further comprising a rod member on which said disc is mounted and which lies along a central axis of said barrel, said rod member engaging a depression formed in said means to therewith define a variable volume suction chamber, said valve assembly being disposed for sliding movement within said passage toward said means during the valve open condition and away from said means during the valve closed condition, said suction chamber being expanded during the movement away from said means for retracting liquid product inwardly of said orifice.

42. The discharge valve assembly according to claim 41, wherein the valve disc is located adjacent an upstream end of the barrel.

43. The discharge valve assembly according to claim 41, wherein the valve disc is located adjacent said spin mechanics means.

44. The discharge valve assembly according to claim 41, wherein the valve disc is of flexible material.

45. The discharge valve assembly according to claim 41, wherein spring means are located in said suction chamber for biasing said rod member away from said orifice.

* * * * *